US006252620B1

(12) United States Patent
Funayama et al.

(10) Patent No.: US 6,252,620 B1
(45) Date of Patent: Jun. 26, 2001

(54) IMAGE RECORDING APPARATUS AND IMAGE RECORDING METHOD

(75) Inventors: Yasuhiro Funayama; Tsutomu Uezono; Takeshi Hori; Tomoyuki Yoshii, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/346,584

(22) Filed: Jul. 2, 1999

(30) Foreign Application Priority Data

Jul. 3, 1998 (JP) ..... 10-188443

(51) Int. Cl.[7] ..... B41J 2/39
(52) U.S. Cl. ..... 347/141; 347/128; 399/159
(58) Field of Search ..... 347/262, 264, 347/127, 128, 141; 399/159, 270, 271, 291

(56) References Cited

U.S. PATENT DOCUMENTS 5,815,774 9/1998 Funayama ..... 399/159

FOREIGN PATENT DOCUMENTS 57-109953 7/1982 (JP) .
60-154771 8/1985 (JP) .
62-127249 6/1987 (JP) .
2-24671 1/1990 (JP) .
2-121846 5/1990 (JP) .
7-191530 7/1995 (JP) .
9-204092 8/1997 (JP) .

*Primary Examiner*—N. Le
*Assistant Examiner*—Hai C. Pham
(74) *Attorney, Agent, or Firm*—Foley & Lardner

(57) ABSTRACT

An image recording apparatus and an image recording method enable high density and without blank space between pixels printed on a recording medium to be printed. The image recording apparatus comprises a multi-hole photoreceptor provided with a transparent conductive layer, photoconductive layer, and multi-hole layer having a plurality of holes arranged with equal interval, on a transparent supporting structure, and an opposite electrode arranged so as to be opposite to the multi-hole photoreceptor with interval while inserting a recording medium. Conductive colored particles which fly in order from a plurality of holes of the multi-hole photoreceptor form respective pixels by driving the multi-hole photoreceptor corresponding to the pixel.

36 Claims, 8 Drawing Sheets

IMAGE RECORDING APPARATUS AND IMAGE RECORDING METHOD

BACKGROUND OF THE INVENTION

The present invention relates to an image recording apparatus and an image recording method which are used for a copying machine, a printer, a facsimile and so forth.

DESCRIPTION OF THE PRIOR ART

An electrophotographic process which is an image forming technology of a conventional copying machine and also a printer is applied universally. The Carlson method (Xerography) which is representative process thereof needs six manufacturing processes of a charging, an exposure, a development, a transfer, a fixing, and a cleaning. An electrophotographic process instead of the Carlson method as a simplified electrophotographic process is disclosed in which charging of a photoreceptor is unnecessary, and implementing the exposure, the development, and transfer at the same time, in regard of the Japanese Patent Application Laid-Open No. HEI 9-204092 by the inventors of the present invention.

The electrophotographic process disclosed in the Japanese Patent Application Laid-Open No. HEI 9-204092 is described referring to the drawing. FIG. 1 is a view for explaining a printing section of the conventional image recording apparatus schematically. According to FIG. 1, the image recording apparatus comprises a multi-hole photoreceptor 100 constituted in such a way that a transparent conductive layer 2, and a photoconductive layer 3, are laminated on a transparent supporting structure 1, and a multi-hole layer 4 on which an electrode layer 5 is formed with a plurality of penetrated holes is laminated on the surface of the photoconductive layer 3, an electrode member which is not illustrated for holding conductive colored particles 6 on the surface, which electrode member is arranged so as to be opposite to the multi-hole photoreceptor 100 through a gap, a power supply 21 for applying voltage in between the transparent conductive layer 2 and the electrode layer 5, a power supply which is not illustrated for applying voltage in between the transparent conductive layer 2 and the electrode member, an opposite electrode 8 arranged so as to be opposite to the multi-hole photoreceptor 100 inserting a gap and the recording medium 7 at a position different from a part where the electrode 5 is opposite to the multi-hole photoreceptor 100, a third power supply 22 for applying voltage in between the transparent conductive layer 2 and the opposite electrode 8, and an exposure means for irradiating the image light 10 at the photoconductive layer 3 corresponding to an image signal from the side of the transparent supporting structure 1.

There is described operation of the conventional image recording apparatus. The conductive colored particles 6 are filled into the hole of the multi-hole layer 4 in which the conductive colored particles 6 are charged by induction charging. An electric potential of the conductive colored particles 6 is maintained about the same electric potential of an electric potential of the electrode layer 5 in condition that the conductive colored particles 6 are not exposed, therefore an electric field of layer surface of the conductive colored particles 6 filled into the hole is extremely faint, thus the conductive colored particles 6 do not fly. However, when the image light 10 is irradiated, the electric charge of the conductive colored particles 6 is neutralized through the photoconductive layer 3, so that the electric potential decreases. Strong electric field is generated at the surface layer of the conductive colored particles 6 while there appears an electric potential difference between the conductive colored particles and the electrode layer 5. As a result, the conductive colored particles are charged caused by induction charging to fly to the recording medium 7, thus the conductive colored particles adhere thereto to form an image.

In such the conventional method, the pixel formed on the recording medium 7 is corresponding to the hole of the multi-hole layer 4 one by one. On the other hand, in manufacture of the multi-hole layer 4, the more that the wall part between holes of the multi-hole layer is made large, the more that the multi-hole layer is strong dynamically and easy to make.

The Japanese Patent Application Laid-Open No. HEI 7-191530 discloses Image Forming Apparatus which enables no leak of electric charges to occur in the lateral direction while being conducted conductive fine particles or conductive ink only at the exposing section in such a way that the apparatus forms sufficient high electric field within photoconductive layer, and causing the conductive fine particles or conductive ink of the exposing section to be induction charging. Voltage is applied between conductive layer of transfer sheet and transparent conductive layer of photoreceptor to form high electric field within photoconductive layer. Thus electric charge injection occurs for conductive colored particle or conductive ink only at image exposing section so that the particles undergo induction charging to fly to recording paper at intervals of gap according to electrostatic field, so adhering thereto.

The Japanese Patent Application Laid-Open No. SHO 60-154771 discloses Image Recording Apparatus which comprises a recording structure to which transparent conductive layer and photoconductive layer are laminated, a toner development means forming charged toner layer evenly on the recording structure, and a toner image transfer means in which transfer purpose electrode at the side of recording medium while inserting recording structure consisting of charged toner layer and the recording medium along with thereon and light irradiation section reverse surface side of the recording structure are arranged oppositely with each other, wherein the apparatus applies same polarity of voltage with charged toner to the transfer purpose electrode of toner image transfer means, and implementing light irradiation to the moving recording structure with the recording medium corresponding to image pattern according to the light irradiation section, so transferring charged toner layer part light-irradiated in electrostatic way, further, fixing means fixes the toner image formed on the recording medium.

However, in the electrophotographic process disclosed in the Japanese Patent Application Laid-Open No. HEI 9-204092 and so forth, the pixel formed on the recording medium 7 is corresponding to the hole of the multi-hole layer 4 one by one, therefore, insulating wall part of the multi-hole layer 4 between the holes into which the conductive colored particles are filled can not form an image inevitably, particularly for an even image part, and resolution of the multi-hole layer 4 deteriorates. In the case where rate of area of wall part is large, unevenness of color occurs, while in the case where resolution is high, there is the problem that image density decreases together with lowering of area rate of the hole.

SUMMARY OF THE INVENTION

In view of the foregoing, it is an object of the present invention, in order to overcome the above mentioned problem to provide an image recording apparatus and an image recording method in which it is capable of being implemented high density print with no blank space in between pixels printed on the recording medium.

According to a first aspect of the present invention, in order to achieve the above-mentioned object, there is provided an image recording apparatus which comprises a multi-hole photoreceptor of an approximate columnar shape provided with a multi-hole layer of prescribed thickness on which an electrode layer is formed only in respect of a surface thereof having a plurality of holes arranged in equal intervals on a photoreceptor formed in such a way that transparent conductive layer and photoconductive layer are laminated in order on a transparent supporting structure, an opposite electrode arranged so as to be opposite to the multi-hole photoreceptor with an interval while inserting a recording medium, and an exposure means for exposing in answer to an image signal from a side of the transparent supporting structure of the multi-hole photoreceptor, wherein conductive colored particles which fly in order from a plurality of holes of the multi-hole photoreceptor to adhere to the recording medium repeatedly, thus respective pixels on the recording medium are constituted due to overlapping conductive colored particles.

According to a second aspect of the present invention, there is provided an image recording apparatus which comprises a multi-hole photoreceptor of an approximate columnar shape provided with a multi-hole layer of prescribed thickness on which an electrode layer is formed only in respect of a surface thereof and with a plurality of holes arranged in equal intervals on a photoreceptor formed in such a way that transparent conductive layer and photoconductive layer are laminated in order on a transparent supporting structure, an opposite electrode arranged so as to be opposite to the multi-hole photoreceptor with an interval while inserting a recording medium, and an exposure means for exposing in answer to an image signal from a side of the transparent supporting structure of the multi-hole photoreceptor, comprising a means for rotating the multi-hole photoreceptor of an approximate columnar shape, rotating the multi-hole photoreceptor in correspondence to the pixels on the recording medium such that respective pixels on the recording medium are constructed due to having conductive colored particles flying from a plurality of holes of the multi-hole photoreceptor in order adhere to the recording medium.

According to a third aspect of the present invention, there is provided an image recording apparatus which comprises a multi-hole photoreceptor of an approximate columnar shape provided with a multi-hole layer of prescribed thickness on which an electrode layer is formed only in respect of a surface thereof and with a plurality of holes arranged in equal intervals on a photoreceptor formed in such a way that transparent conductive layer and photoconductive layer are laminated in order on a transparent supporting structure, an opposite electrode arranged so as to be opposite to the multi-hole photoreceptor with an interval while inserting a recording medium, and an exposure means for exposing in answer to an image signal from a side of the transparent supporting structure of the multi-hole photoreceptor, comprising a means for rotating the multi-hole photoreceptor of an approximate columnar shape, and a means for moving with high precision the recording medium arranged as connecting with the opposite electrode, wherein the multi-hole photoreceptor and the recording medium are mutually driven as they correspond to each other, such that respective pixels on the recording medium is constructed due to having conductive colored particles flying from a plurality of holes of the multi-hole photoreceptor in order to adhere to the recording medium.

According to a fourth aspect of the present invention, there is provided an image recording apparatus which comprises a multi-hole photoreceptor of an approximate columnar shape provided with a multi-hole layer of prescribed thickness on which an electrode layer is formed only in respect of a surface thereof and with a plurality of holes arranged in equal intervals on a photoreceptor formed in such a way that transparent conductive layer and photoconductive layer are laminated in order on a transparent supporting structure, an opposite electrode arranged so as to be opposite to the multi-hole photoreceptor with an interval while inserting a recording medium, and an exposure means for exposing in answer to an image signal from a side of the transparent supporting structure of the multi-hole photoreceptor, comprising a means for applying voltage independently to a plurality of divided opposite electrodes insulated from each other as they form the opposite electrode, the means enabling control on a flying direction of the conductive colored particles which fly selectively from the holes on the multi-hole photoreceptor.

According to a fifth aspect of the present invention, in the fourth aspect, there is provided an image recording apparatus, wherein the means for applying voltage has a pulse generator, and a voltage amplifier for amplifying an output voltage from the pulse generator.

According to a sixth aspect of the present invention, in any of the first to fifth aspects, there is provided an image recording apparatus, wherein the multi-hole layer is constituted by an insulator or a photoconductive layer.

According to a seventh aspect of the present invention, in any of the first to sixth aspects, there is provided an image recording apparatus, wherein a plurality of holes on the multi-hole photoreceptor of an approximate columnar shape are arranged in a predetermined pitch in the longitudinal direction of the column, while a neighboring row in the rotation direction of the column are formed by a plurality of holes arranged in the predetermined pitch in the longitudinal direction approximately shifted by 1/X of the predetermined pitch from the preceding row, while such rows of holes are repeated by a unit of X rows.

According to an eighth aspect of the present invention, in the third aspect, there is provided an image recording apparatus, wherein when respective pixels on the recording medium is formed by conductive colored particles flying from Y holes in order, a relationship between velocity V1 of the multi-hole photoreceptor in the rotational direction and moving velocity V2 of the recording medium can be represented by a following expression (1):

$$V1=V2\times\text{pitch of holes in rotational direction of multi-hole layer}\times Y/\text{pitch of pixels} \quad (1)$$

According to a ninth aspect of the present invention, in any of the first to eighth aspect, there is provided an image recording apparatus, which comprises a means for exposing from within the multi-hole receptor opposing against a central part of a plurality of divided opposite electrodes.

According to a tenth aspect of the present invention, there is provided an image recording method using an image recording apparatus which comprises a multi-hole photoreceptor of an approximate columnar shape provided with a multi-hole layer of prescribed thickness on which an electrode layer is formed only in respect of a surface thereof and with a plurality of holes arranged in equal intervals on a photoreceptor formed in such a way that transparent conductive layer and photoconductive layer are laminated in order on a transparent supporting structure, an opposite electrode arranged so as to be opposite to the multi-hole photoreceptor with an interval while inserting a recording medium, and an exposure means for exposing in answer to an image signal from a side of the transparent supporting structure of the multi-hole photoreceptor, wherein the multi-hole photoreceptor and the recording medium are mutually driven while they correspond to each other, such that respective pixels on the recording medium is constructed due to having conductive colored particles flying from a plurality of holes of the multi-hole photoreceptor in order adhere to the recording medium.

According to an eleventh aspect of the present invention, in the tenth aspect, there is provided an image recording method, wherein when respective pixels on the recording medium is formed by conductive colored particles flying from Y holes in order, a relationship between velocity V1 of the multi-hole photoreceptor in the rotational direction and moving velocity V2 of the recording medium can be represented by a following expression (1):

$$V1=V2\times\text{pitch of holes in rotational direction of multi-hole layer}\times Y/\text{pitch of pixels} \quad (1)$$

According to a twelfth aspect of the present invention, there is provided an image recording method using an image recording apparatus which comprises a multi-hole photoreceptor of an approximate columnar shape provided with a multi-hole layer of prescribed thickness on which an electrode layer is formed only in respect of a surface thereof and with a plurality of holes arranged in equal intervals on a photoreceptor formed in such a way that transparent conductive layer and photoconductive layer are laminated in order on a transparent supporting structure, an opposite electrode arranged so as to be opposite to said multi-hole photoreceptor with an interval while inserting a recording medium, and an exposure means for exposing in answer to an image signal from a side of the transparent supporting structure of the multi-hole photoreceptor, wherein voltage is independently applied to each of a plurality of divided opposite electrodes insulated from each other as they form the opposite electrode, so as to control a flying direction of the conductive colored particles which fly selectively from the holes on the multi-hole photoreceptor.

The above and further objects and novel features of the invention will be more fully understood from the following detailed description when the same is read in connection with the accompanying drawings. It should be expressly understood, however, that the drawings are for purpose of illustration only and are not intended as a definition of the limits on the invention.

DETAILED DESCRIPTION OF THE PREFERRED EMBODIMENTS

An image recording apparatus of the present invention, in a preferable enforcement, comprises a transparent conductive layer on a transparent supporting structure, a multi-hole photoreceptor provided with a multi-hole layer having a plurality of holes arranged in equal interval to a photoconductive layer, and an opposite electrode which is arranged opposite to the multi-hole photoreceptor with a few intervals while inserting a recording medium, wherein the image recording apparatus causes the multi-hole photoreceptor to be driven corresponding to the pixel, thereby conductive colored particle flying in order from a plurality of holes of the multi-hole photoreceptor is overlapped on the recording medium, thus respective pixels on the recording medium is formed.

A preferred embodiment of the present invention will be described in detail in accordance with the accompanying drawings in order to explain in more detail the enforcement of the above described enforcement.

[Embodiment 1]

Figure 1:
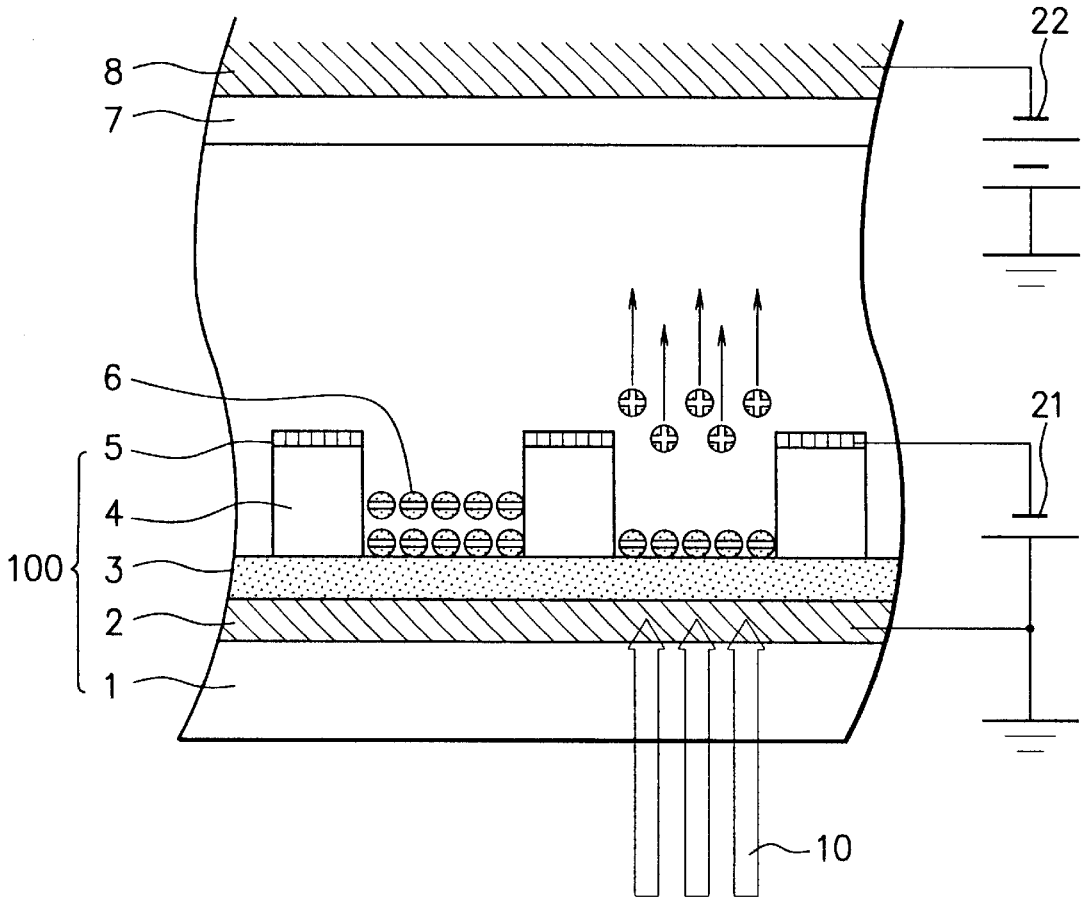
FIG. 1 PRIOR ART
FIG. 1 is a sectional view showing a constitution of the conventional image recording apparatus.
Figure 2:
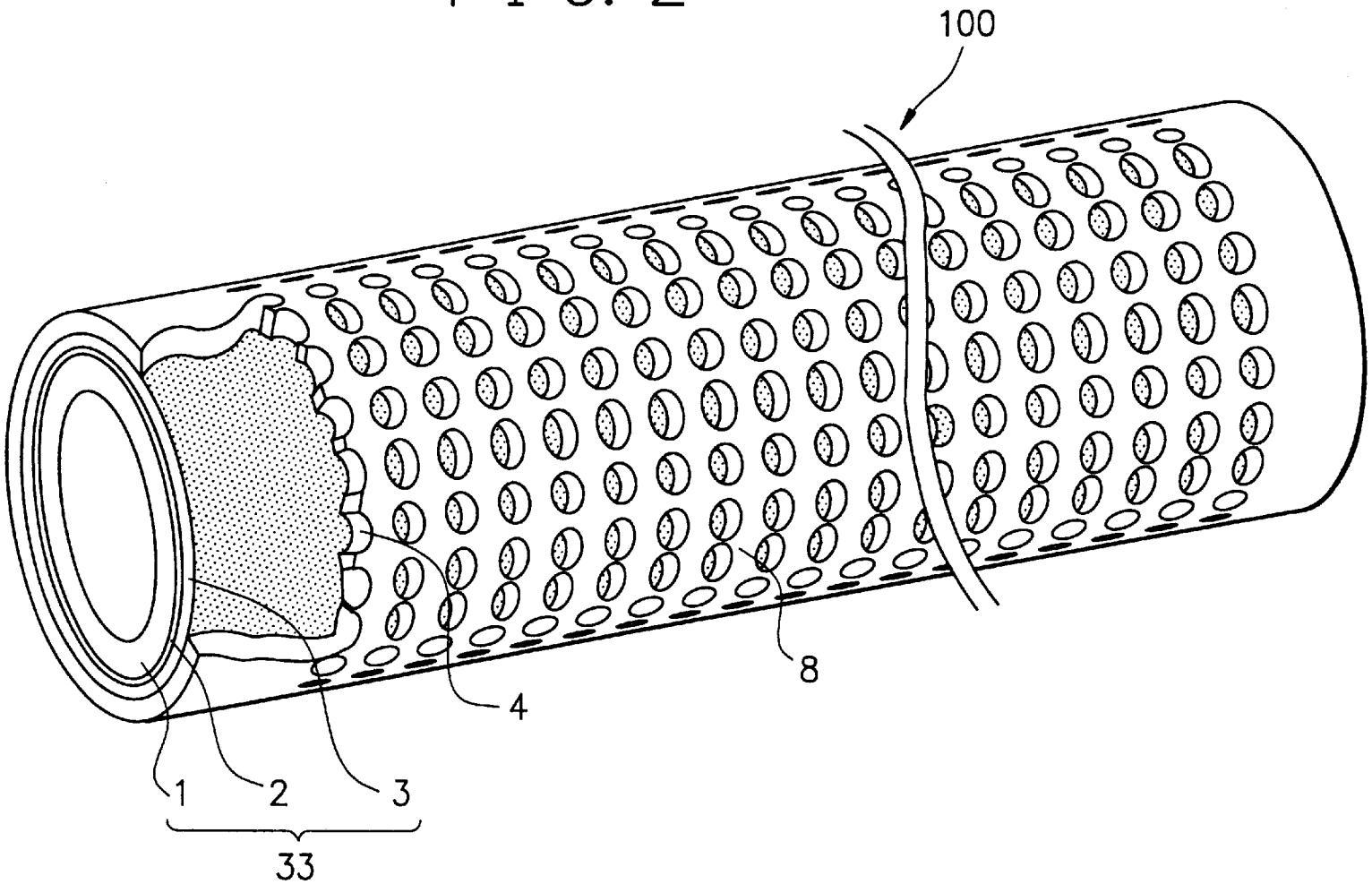
FIG. 2 is a perspective view showing the whole of multi-hole photoreceptor of an image recording apparatus according to the present invention.
Figure 3:
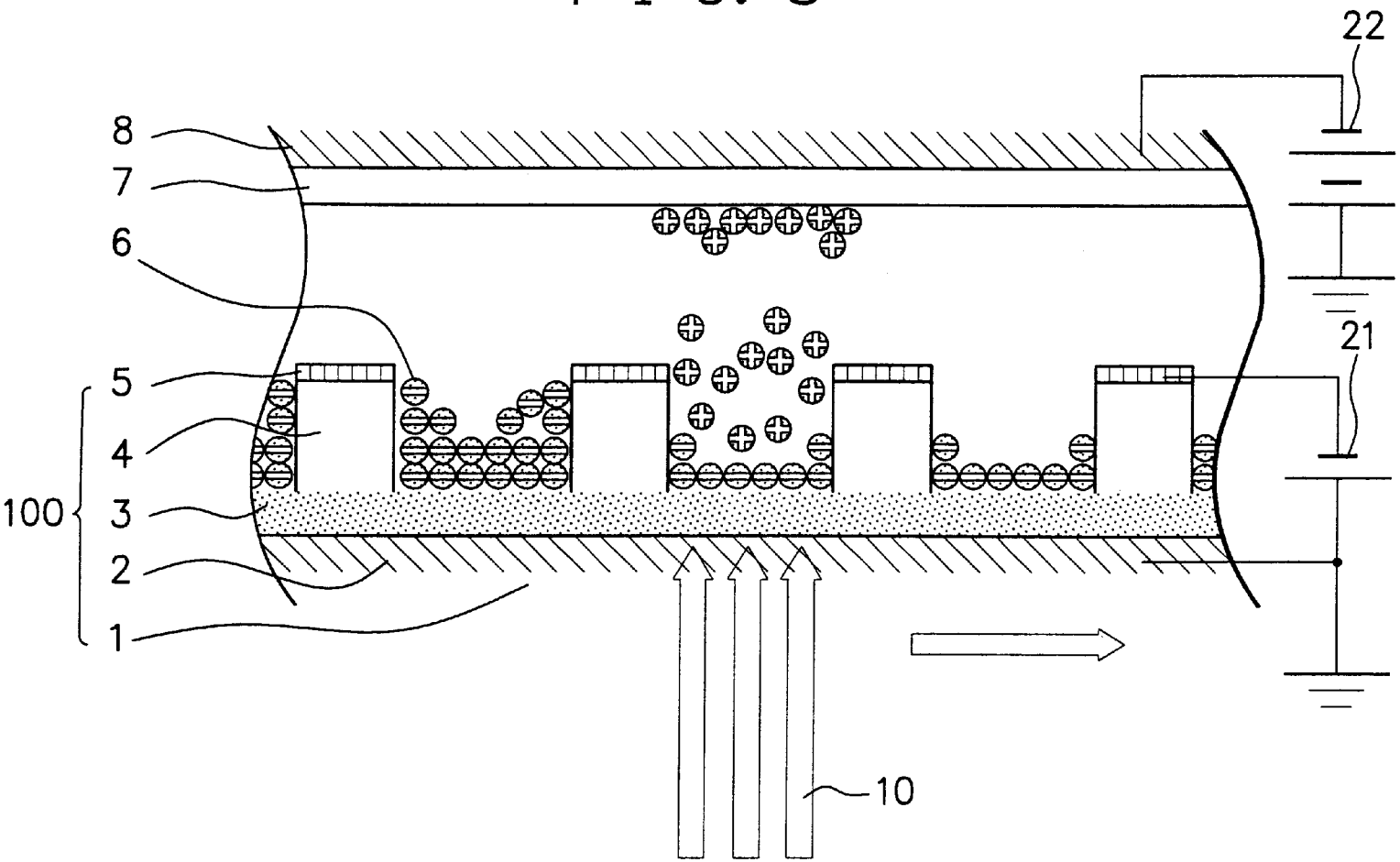
FIG. 3 is a sectional view for explaining schematically recording section of the image recording apparatus according to a first embodiment of the present invention.
Figure 4:
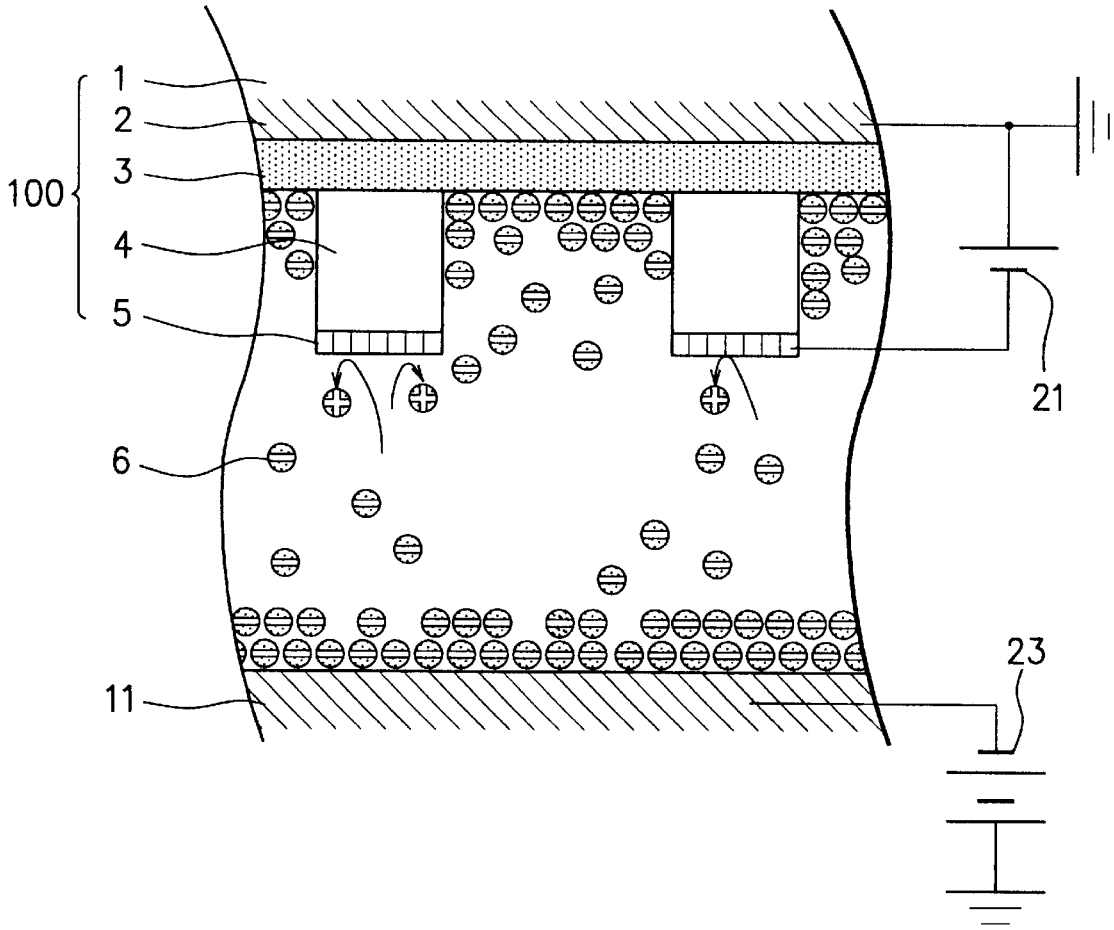
FIG. 4 is a sectional view for explaining filling up process of particle of the image recording apparatus of the present invention.

FIG. 2 is a perspective view showing the whole of multi-hole photoreceptor of an image recording apparatus according to the present invention. FIG. 3 is a sectional view for explaining schematically recording section of the image recording apparatus according to a first embodiment of the present invention. FIG. 4 is a sectional view for explaining filling up process of particle of the image recording apparatus of the present invention. Further, in order to facilitate understanding, shape thereof is modified partially.

Referring to FIG. 2, the multi-hole photoreceptor 100 is provided with a photoreceptor 33 in which a transparent conductive layer 2 and a photoconductive layer 3 are laminated in order on a cylindrical transparent supporting structure 1. A multi-hole layer (insulating layer) 4 which have a plurality of holes (penetrated hole) and electrode layer 5 on the surface, is laminated on the surface of the drum shaped photoreceptor 33, namely on the photoconductive layer 3. The multi-hole photoreceptor 100 is formed in such a way that the transparent conductive layer 2 and the photoconductive layer 3 are formed on the transparent supporting structure 1 such as for instance, glass, acrylic, PET (polyethylene terephthalate) and so forth, and a multi-hole shaped multi-hole layer 4 is arranged thereon, and an electrode layer (hereinafter referring to an electrode layer 5) is formed only on the upper surface of the multi-hole layer 4.

As the transparent conductive layer 2, for instance, metallic semi-transparent film such as thin aluminum film formed by evaporating method, or ITO film is used. As the photoconductive layer 3, an inorganic photoconductive layer such as amorphous selenium, amorphous silicon, or photoconductive layer used for well known electrophotographic method such as an organic photoconductive layer is capable of being used. As the multi-hole layer 4, screen and so forth are used in such a way that a plurality of holes are provided in non-conductive polymer film such as polyimide, PET, or PC. Further, it is also capable of being used photoconductive layer such as the organic photoconductive layer. In this case, for instance, the photoconductive layer 3 is formed in such a way that the photoconductive layer 3 is formed thickly corresponding to thickness of the multi-hole layer 4, then the plurality of holes are formed.

As to the thickness of the multi-hole layer 4, at least more than two times of the diameter of conductive colored particle 6 used for the recording is necessary. In the exposure process implemented later, the exposure process causes the conductive colored particle 6 of a plurality of layers to be polarized selectively into upper and/or lower layer according to the exposure, subsequently, selection is implemented in connection with the conductive colored particle for the sake of recording in such a way that the exposure process causes conductive particle of the upper layer to be induction charging. When the thickness of the multi-hole layer 4 is less than two times of diameter of the conductive colored particle, particle layer becomes single layer in connection with the conductive colored particles 6 filled into the hole of the multi-hole layer 4, in such the condition, charging/flight is not implemented preferably according to the induction charging of the conductive colored particle 6.

Next, there will be described a recording method of an image referring to FIG. 3. The conductive colored particles 6 undergoing induction charging are filled according to the particle filling up process describing later on the multi-hole photoreceptor 100. The recording medium 7 and the opposite electrode 8 are arranged to be opposite to with each other while inserting the multi-hole photoreceptor 100 and a gap. Voltage is applied to the electrode layer 5 by the power supply 21. Voltage is applied to the opposite electrode 8 by the power supply 22.

When light is applied from the rear of the multi-hole photoreceptor 100, the photoconductive layer 3 of irradiated parts becomes conductive state. As a result, the charges of the conductive colored particles 6 leak. Positive charges are induced on a particle layer of the side of the recording medium. The particles fly from the holes of the multi-hole layer. The conductive colored particles 6 adhere to the recording medium 7. Further, the multi-hole photoreceptor 100 moves in a transfer direction. When the next hole into which the conductive colored particles 6 are filled arrives at the exposure position, the exposure is implemented. The apparatus causes the particle to fly to adhere to the same position. The apparatus forms one pixel on the storage medium 7 in such a way that the apparatus repeats the above described process of a plurality of times so as to cause the conductive colored particles 6 flying from a plurality of holes to adhere to the recording medium.

Next, there will be described a filling process of the conductive colored particles 6 to the hole of the multi-hole layer 4 of the multi-hole photoreceptor 100 in the present embodiment in detail referring to FIG. 4. A thin layer of the conductive colored particles 6 is formed on an electrode member 11 beforehand using well known thin layer forming technology such as toner layer depth restriction blade and so forth. Such thin layer of the conductive colored particles 6 is arranged so as to be opposite to the multi-hole photoreceptor 100 through the gap. DC voltage according to the power supply 21 and the power supply 23 are applied to the electrode layer 5 and the electrode member 11 respectively with the transparent conductive layer 2 as the ground in such a way that the power supply 23 causes a first DC voltage to be applied to the multi-hole photoreceptor 100 so as to render the transparent conductive layer 2 positive, and so as to render the electrode member 11 negative, and that the power supply 21 causes a second DC voltage to be applied to the multi-hole photorecepter 100 so as to render the transparent conductive layer 2 positive, and so as to render the electrode layer 5 of surface of the multi-hole layer 4 negative simultaneously.

For instance, on the assumption that the transparent conductive layer 2 is taken as the ground, the first DC voltage applied to the electrode member 11 is taken as −1000V, the second DC voltage applied to the electrode layer 5 is taken as −70V, thickness of the photoconductive layer 3 is taken to be 5 $\mu$m, the conductive colored particles 6 undergoes induction charging with negative due to electric field to fly in the direction of the photoconductive layer 3. The flying conductive colored particles 6 bump also the surface of the electrode layer 5, however, the conductive colored particles 6 return to the side of the electrode member 11 while being charged immediately in reverse polarity. For that reason, the conductive colored particles 6 which become negatively charged enters into only the hole of the multi-hole layer 4.

A desirable gap is approximately 0.1 to 5 mm between the electrode layer 5 and the electrode member 11 of the filling up parts of the conductive colored particles 6, more desirably the gap is approximately 0.5 to 2 mm. The conductive colored particles 6 are filled into the hole of the multi-hole layer 4 with the particle oscillating between the gap. If it causes interval of the gap to be narrow, number of times of the oscillation increases, thus filling up time becomes short. It is necessary to secure an interval which is more than a fixed interval for preventing discharge when gap interval decreases because of eccentricity of respective rollers. Electric potential of the conductive colored particles 6 after filling up is approximately equal to electric potential of the electrode layer 5, therefore it is capable of being generated the electric field more than $10^5$ V /cm which is sufficient to induce photoconductive phenomenon within the photoconductive layer 3 of lower parts of the conductive colored particles 6.

According to the method described above, as shown in FIG. 3, the conductive colored particles 6 become charged condition beforehand is filled into the hole of the multi-hole layer 4. In the case of the present embodiment, the conductive colored particles 6 become negatively charged condition according to the power supply 23. The size of the hole, and interval therebetween are related to resolution of the image, therefore it is desirable to diminish as far as possible. Since in order to secure image density, it is necessary to maintain number of particles more than certain degree within the hole, regarding one side or diameter of the hole of the multi-hole layer, approximately 20 to 100 $\mu$m are desirable.

As described above, in the image recording apparatus according to the present embodiment, the photoreceptor is constituted in such a way that the transparent conductive layer 2 and the photoconductive layer 3 are laminated in order on the transparent supporting structure 1, subsequently, the electrode layer 5 is further formed only on the surface of the multi-hole layer 4. The image recording apparatus comprises the multi-hole photoreceptor 100 provided with the multi-hole layer 4 of fixed thickness, with a plurality of holes arranged in equal interval, the opposite electrode 8 arranged so as to be opposite to the multi-hole photoreceptor 100 inserting the gap and the recording medium 7, and the exposure means for exposing corresponding to the image signal from the side of the transparent supporting structure 1 of the multi-hole photorecepter 100.

The apparatus drives the multi-hole photoreceptor 100 corresponding to the pixel in order to cause the conductive colored particles 6 to fly in order from a plurality of holes, thus overlapping the conductive colored particles on the recording medium 7 so as to form one pixel, with the result that it is capable of obtaining sufficient image density.

[Embodiment 2]

Figure 5A:
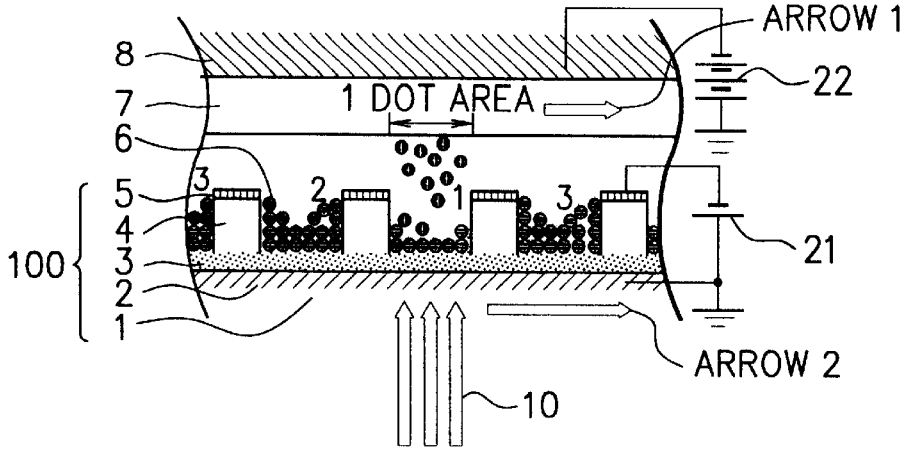
FIGS. 5(A) to 5(C) are sectional views for explaining an image forming process of the image recording apparatus according to a second embodiment of the present invention.
Figure 5B:
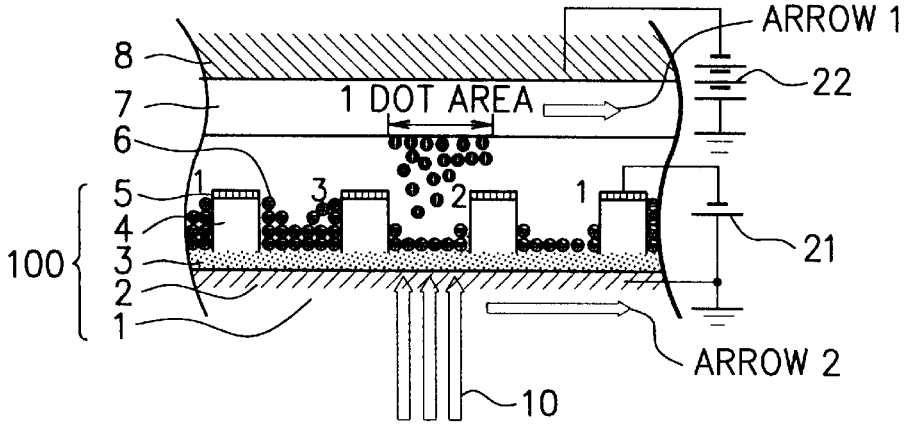
Figure 5C:
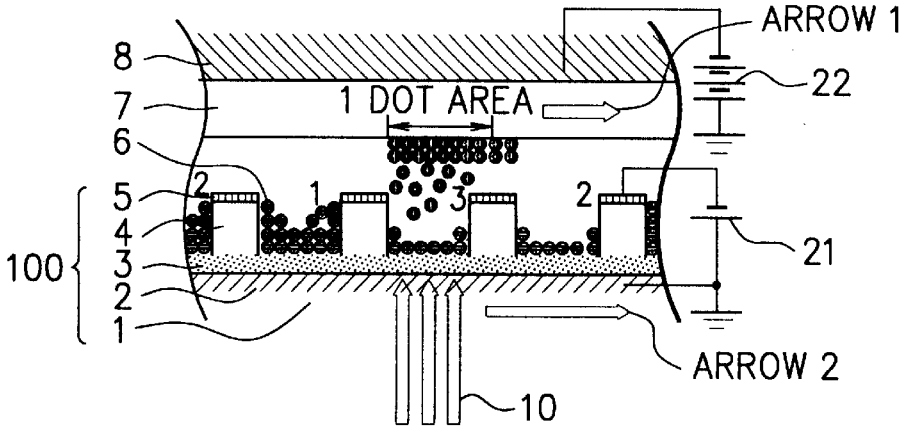

There will be described in detail a second embodiment of the present invention referring to FIGS. 5(A) to 5(C). FIGS. 5(A) to 5(C) are sectional views showing constitution of opposite parts between the multi-hole photoreceptor 100 and the recording medium 7 as the recording section, and from FIG. 5(A) to FIG. 5(C) show image recording process. The conductive colored particles 6 with the state of induction charging are filled into the multi-hole photoreceptor 100 according to the particle filling up process described above. The recording medium 7 and the opposite electrode 8 are arranged in such a way that the multi-hole photoreceptor 100 and the gap intervene therebetween, and voltage is applied to the electrode layer 5 by the power supply 21, and voltage is applied to the opposite electrode 8 by the power supply 22.

The present embodiment shows the image recording process for forming one pixel according to the conductive colored particles 6 flying from three holes 1, 2 and 3 of the multi-hole layer 4. The recording medium 7 repeats a movement and/or a stop in the direction of an arrow 1, and the multi-hole photoreceptor 100 moves in the direction of an arrow 2. In the present embodiment, since one pixel is formed using three holes, the multi-hole photoreceptor 100 moves corresponding to three holes while the recording medium 7 moves corresponding to one pixel. Thus the conductive colored particles 6 flies from the hole on prescribed exposed position in answer to the light 10. Here, there will be described the preventing method of blank space of pixel caused by wall between holes of the multi-hole layer to which the conductive colored particles 6 are not filled.

FIG. 5(A) is a sectional view showing the case where the apparatus causes the conductive colored particles 6 to fly from the first hole. When the recording medium 7 exists at the position of FIG. 5(A), the light 10 is applied to the first hole of the multi-hole layer, thus the conductive colored particles fly. Continuously, as shown in FIG. 5(B), the recording medium 7 moves a little in the direction of the arrow 1, at the time when the second hole 2 shifts to the exposing position, the exposure is implemented, thus the conductive colored particles 6 fly while shifting a little from the area of one dot of FIG. 5(A). As shown in FIG. 5(C), furthermore, the recording medium 7 moves in the direction of the arrow 1. When the third hole 3 shifts to the exposing position, the exposure is implemented again. The conductive colored particles 6 fly while further shifting from the area of one dot of FIG. 5(B). Subsequently, the recording medium 7 moves corresponding to one dot, thus returning to the condition of FIG. 5(A). The same process is repeated.

Here, it is capable of being formed an image without a blank space in the direction of paper transfer (in the direction of the arrow 2), in such a way that the recording medium is transferred while being interlocked by movement of the multi-hole photoreceptor 100 so as to leave no blank space between the dots adjacent to each other formed on the recording medium. It is capable of being used stepping motor and so forth possible to drive with high accurate control for the sake of the transfer of the recording medium.

The image recording apparatus according to the present embodiment comprises an opposite electrode whose surface moves, and means for shifting a circumference of the opposite electrode high accurately, being opposite to the multi-photoreceptor. The recording medium moves high accurately together with the opposite electrode. The conductive colored particles fly from a plurality of holes of the rotated multi-hole photoreceptor, so that flying conductive colored particles shift little by little in order. Thus one pixel is formed by this way so that it becomes possible to print without blank space between pixels in the direction of transfer.

In the above description, the conductive colored particles 6 fly from three holes of the multi-hole layer to form one pixel on the recording medium 7. However, the present invention is not restricted from the above described way that one pixel consists of three holes. For instance, one pixel is capable of being constituted by a plurality of holes of two or four holes. Further, in opposite parts between the multi-hole photoreceptor and the recording medium, description is that the multi-hole photoreceptor and the recording medium move in the same direction, however it is suitable that the movement direction is opposite. Furthermore, in the present embodiment, the description is that surface of the opposite electrode moves, however, it is suitable that the opposite electrode is fixed and only the recording medium is transferred.

[Embodiment 3]

Figure 6A:
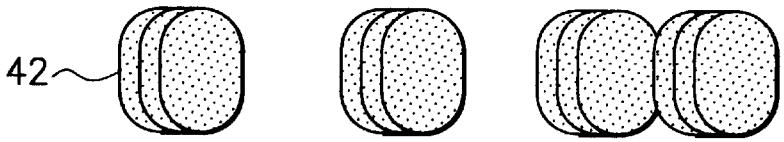
FIGS. 6(A), 6(B) are views for explaining arrangement of hole of multi-hole photoreceptor according to a third embodiment of the present invention.
Figure 6B:
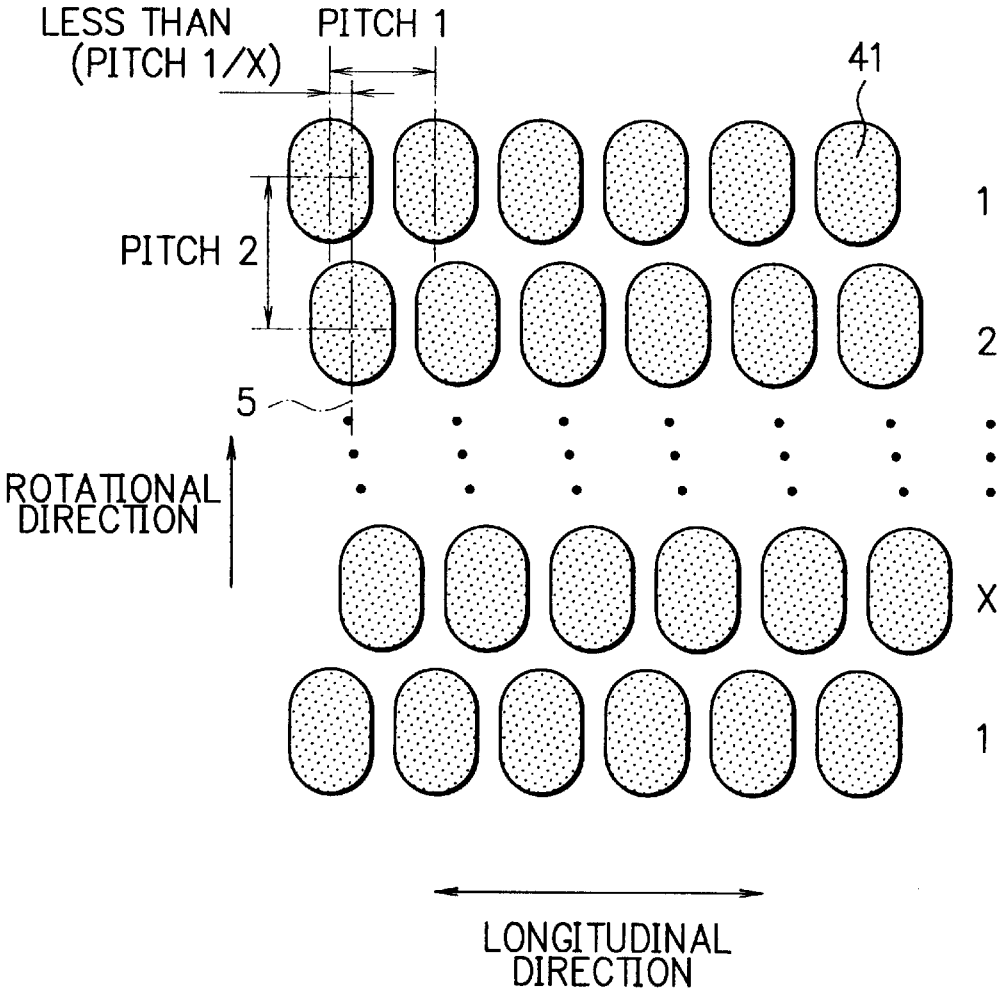

There will be described a third embodiment of the present invention in detail referring to FIGS. 6(A), 6(B). FIGS. 6(A), 6(B) are views showing relationship between pixel of the image recording apparatus and hole of multi-hole layer according to the third embodiment of the present invention. Further, FIG. 6(A) is view showing the situation of the pixel schematically on the recording medium, and FIG. 6(B) is a plan view showing arrangement of the hole of the multi-hole photoreceptor. The third embodiment relates to a method in which it is capable of being formed an image without a blank space at the time of image forming in the direction of paper transfer (in the direction of the arrow 2), and in the perpendicular direction (longitudinal direction of the photoreceptor of FIG. 2) in the wall parts between holes of the multi-hole layer to which the conductive colored particles 6 are not filled.

Referring to FIGS. 6(A), 6(B), when the conductive colored particles 6 fly from the holes of X pieces to form one pixel, the multi-hole photoreceptor 100 forms a row of the holes in such a way that the row of the holes formed with pitch 1 in the longitudinal direction, and the row of holes shifted only less than about pitch 1/X in the longitudinal direction together with pitch 2 in the rotational direction are formed repeatedly in every X rows. Further, it is desirable that a divergence between holes is degree of ½ of the pitch 1. Because, when the divergence is large, interference (overlapping) becomes large, thus the image becomes dim.

The conductive colored particles fly from the holes of X pieces of the multi-hole layer to form one pixel on the recording medium 7 as shown in FIG. 6(A). Reference numerals 1, 2, . . . within FIG. 6(B) correspond to the number 1, 2, and 3 of the holes of the multi-hole layer within FIGS. 5(A) to 5(C). A formed pixel 42 is formed on the recording medium in such a way that the conductive colored particles which fly from the holes shift in every hole according to a divergence of back and forth. According to such arrangement of the holes, printing of high image density becomes possible at the even parts without occurrence of blank space between pixels which occurs in the cases where there is no divergence of the holes in the longitudinal direction.

The image recording apparatus according to the present embodiment comprises divided opposite electrode formed with a plurality of electrodes, and a means for applying voltage to the divided opposite electrode. The voltage applying means to the divided electrode controls flight direction of the conductive colored particles which fly from the holes of the multi-hole layer. The present embodiment causes the conductive colored particles to be placed one upon another on one pixel, which conductive colored particles fly from a plurality of holes of the multi-hole layer. Consequently, the multi-hole photoreceptor forms the row of the holes in such a way that the row of the hole formed with the pitch 1 in the longitudinal direction, and the row of the hole formed with less than about 1/X of the pitch 1 in the longitudinal direction shifted and with the pitch 2 in the rotational direction shifted are formed repeatedly in every X rows. The conductive colored particles fly from the holes of X pieces in order to form one pixel on recording medium. Therefore, it becomes possible to print the image without blank space between pixels in the perpendicular direction to the transfer direction by shifting the arrangement of the holes of the multi-hole photoreceptor. Since one pixel is formed by the conductive colored particles which fly from a plurality of the holes, the method has excellent gradation reproducibility in every one pixel, thus it is suitable for printing photo image.

[Embodiment 4]

Figure 7A:
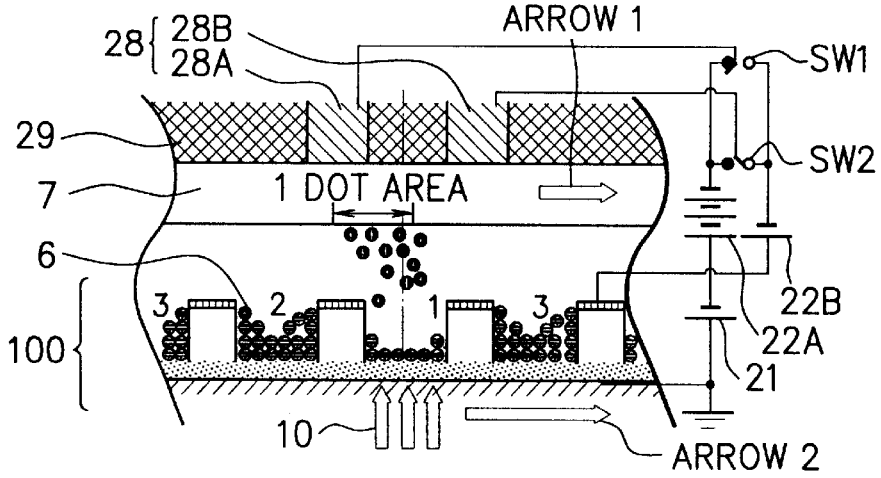
FIGS. 7(A) to 7(C) are sectional views for explaining an image forming process of the image recording apparatus according to a fourth embodiment of the present invention.
Figure 7B:
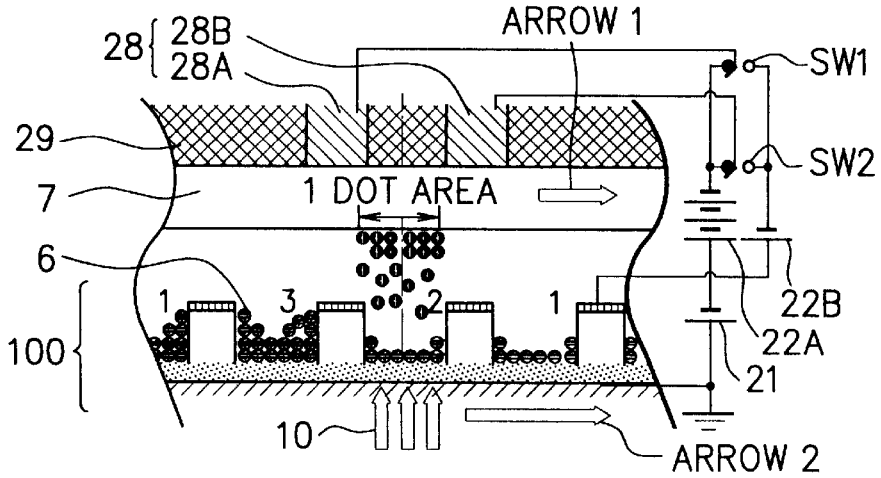
Figure 7C:
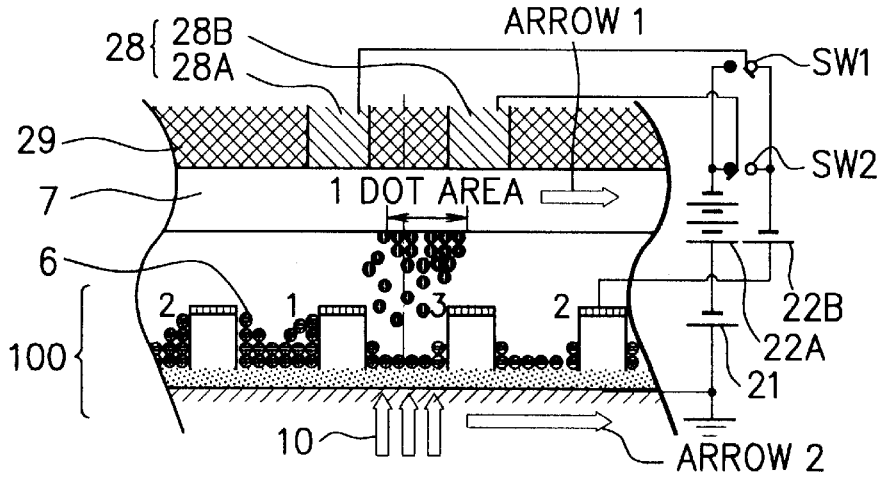

Next, there will be described in detail a fourth embodiment of the present invention referring to FIGS. 7(A) to 7(C). FIGS. 7(A) to 7(C) are sectional views showing image recording process according to the fourth embodiment, denoting the process for forming one pixel by the conductive colored particles 6 which fly from three holes 1, 2, and 3 of the multi-hole layer 4.

The description of arrangement constitution is to carry out using FIG. 7(A). The recording medium 7 and the divided opposite electrode 28 are arranged to be opposite to each other in which the multi-hole photoreceptor 100 and the gap intervene therebetween. The divided opposite electrode consists of two electrodes of an electrode 28A and an electrode 28B, which are fixed on an opposite electrode supporting structure 29. The divided opposite electrode 28A, and 28B are connected to a switch SW1 and a switch SW2 respectively, thus the voltage is applied thereto from a power supply 22A or a power supply 22B. The exposing position is coordinated in such a way that the exposing position becomes a position which is opposite to center between the divided opposite electrodes 28A and 28B. It is capable of being used the way described above using FIG. 4 in connection with filling up of the conductive colored particles 6 into the holes of the multi-hole layer 4 of the multi-hole photoreceptor 100.

According to the method described above, as shown in FIG. 7(A), the conductive colored particles 6 which are charged beforehand are filled into the hole of the multi-hole layer 4. The size of the hole, and interval therebetween are related to resolution of the image, therefore it is desirable to diminish as far as possible. Since in order to secure image density, it is necessary to maintain number of particles more than certain degree within the hole, regarding one side or diameter of the hole of the multi-hole layer, approximately 20 to 100 $\mu$m are desirable.

Next, description is to perform about the image forming process. The recording medium 7 and the multi-hole photoreceptor 100 are moving in the direction of an arrow 1 and an arrow 2 respectively. Since the multi-hole photoreceptor 100 should move corresponding to three holes while the recording medium 7 moves corresponding to one pixel, movement speed (speed of the periphery) of the multi-hole photoreceptor 100 is (the pitch of the hole in the rotational direction of the multi-hole layer) ×3/pixel pitch times to the moving speed of the recording medium 7.

FIG. 7(A) shows the case where the apparatus causes the conductive colored particles 6 to fly from the first hole, at this time, the divided opposite electrode 28A is connected to the power supply 22A through the switch SW1 and the divided opposite electrode 28B is connected to the power supply 22B through the switch SW2, thus electric potentials V2A and V2B are applied respectively. The V2A and the V2B have relationship of $|V2A|>|V2B|\geqq 0$. The particles adhere to one dot area of the recording medium in such a way that the particles which fly after exposure are attracted in the direction of the divided opposite electrode 28A by uneven electric field.

Next, flight of the conductive colored particles 6 from the second hole will be described using FIG. 7(B). The multi-hole photoreceptor 100 moves a distance corresponding to hole one pitch. When the second hole exists in the center between the divided opposite electrodes 28A, and 28B, the recording medium moves distance corresponding to ⅓ pixel pitch. Thus peripheral speed of multi-hole photoreceptor and the movement speed of the recording medium 7 are established in such a way that one dot area becomes the center part between the divided opposite electrodes 28A, and 28B. At this time, the divided opposite electrode 28A is connected to the power supply 22A through the switch SW1, and the divided opposite electrode 28B is connected to the power supply 22A through the switch SW2. For that reason, the particles which fly after exposure are attracted in the direction of center parts between the divided opposite electrodes 28A, and 28B, according to even electric field to adhere to one dot area on the recording medium 7 of FIG. 7(B).

Further, there will be described flight of the conductive colored particles 6 from the third hole referring to FIG. 7(C). The multi-hole photoreceptor 100 moves corresponding to 2 pitches of the hole so that the third hole exists in center part between the divided opposite electrodes 28A, and 28B. The recording medium 7 moves corresponding to ⅔ pixel pitch so that 1 (one) dot area exists in the side of divided opposite electrode 28B regarding the center part between the divided opposite electrodes 28A, and 28B. At this time, the divided opposite electrode 28A is connected to the power supply 22B through the switch SW1, and the divided opposite electrode 28B is connected to the power supply 22A through the switch SW2. Namely, the electric field of FIG. 7(C) is symmetrical to an axis of center of the divided opposite electrode in comparison with the electric field of FIG. 7(A). For that reason, the particles which fly after exposure are attracted in the direction of the divided opposite electrode 28B according to uneven electric field to adhere to the 1 (one) dot area on the recording medium 7 of FIG. 7(C).

The above description is the method for forming pixel according to the conductive colored particles which fly from three holes without enlargement of the 1 (one) dot. The blank space does not occur between pixels arranged in the transfer direction in such a way that the recording medium 7 is fixed while the multi-hole photoreceptor 100 moves from the first hole to the third hole. About the method for occurring no blank space according to the wall between holes of the multi-hole layer into which the conductive colored particles 6 are not filled in connection with the direction perpendicular to the transfer direction, it is capable of being realized by using method of the third embodiment described above referring to FIGS. 6(A), 6(B) together.

The present embodiment shows the method for forming one pixel on the recording medium 7 by the conductive colored particles 6 which fly from the three holes of the multi-hole layer. However, the present invention is not restricted with regard to the matter that three holes constitute one pixel. It is suitable that for instance, two or four holes constitute one pixel. In the above example, the switches SW1, SW2, the power supplies 22A, 22B are used as the means for applying voltage to the divided opposite electrode, however, for instance, it is suitable to apply voltage amplified wave form outputted from a pulse generator by an amplifier. Hereinafter, there will be described an example of the pulse voltage wave form.

Figure 8A:
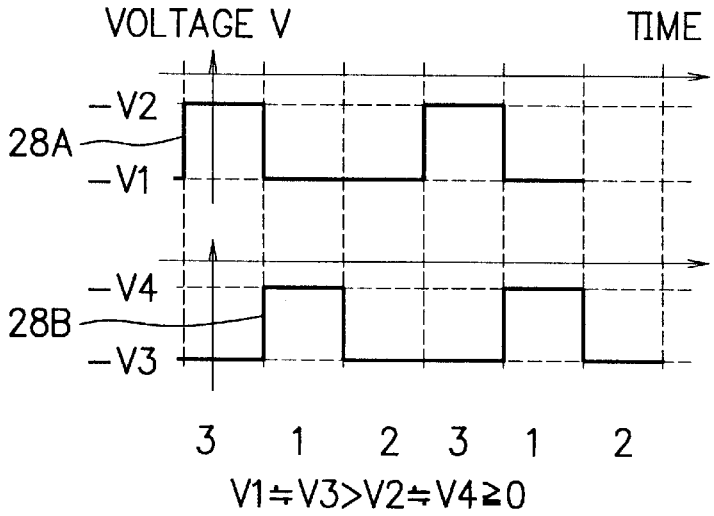
FIGS. 8(A), 8(B) are schematic views showing applied voltage wave form to a divided opposite electrode according to the fourth embodiment of the present invention.
Figure 8B:
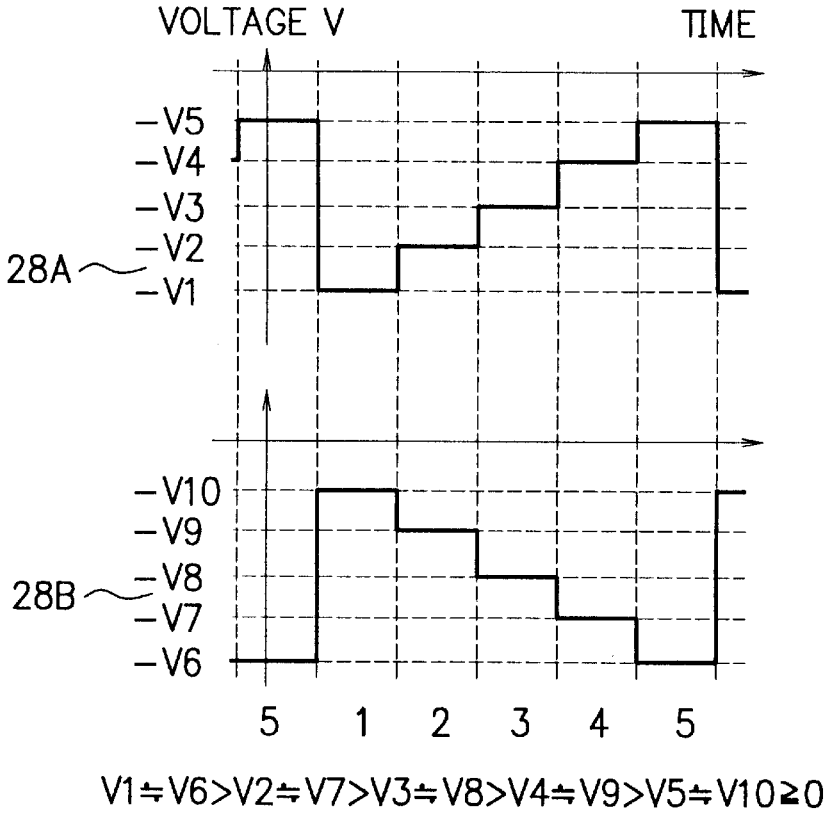

FIGS. 8(A), 8(B) show an applied voltage wave form for the divided opposite electrode. FIG. 8(A) shows a voltage wave form to the divided opposite electrodes 28A, 28B in cases where three holes of multi-hole layer constitute one pixel. V1, V2, V3, and V4 within FIG. 8(A) denote voltage value, with relationship of $V1 \approx V3 \geqq V2 \approx V4 \geqq 0$. Reference numerals 1, 2, and 3 correspond to the reference numerals within FIGS. 7(A) to 7(C) used for the description of the above embodiment. When the conductive colored particles fly from the first hole, voltage−V1 is applied to the divided opposite electrode 28A, and voltage−V4 is applied to the divided opposite electrode 28B. The conductive colored particles which are charged positively fly in the direction of the divided opposite electrode 28A because of $V1>V4$.

When the conductive colored particles fly from the second hole, the voltage−V1 is applied to the divided opposite electrode 28A and the voltage−V3 is applied to the divided opposite electrode 28B. The conductive colored particles 6 fly to intermediate part of the divided opposite electrode because of $V1 \approx V3$. Further, when the conductive colored particles fly from the third hole, the voltage−V2 is applied to the divided opposite electrode 28A and the voltage−V3 is applied to the divided opposite electrode 28B. The conductive colored particles fly in the direction of the divided opposite electrode 28B because of $V2<V3$.

Next, there will be described a method for constituting one pixel using five holes. FIG. 8(B) shows a wave form applied to the divided opposite electrodes 28A and 28B. A numerical value 1 within FIG. 8(B) denotes condition of applied voltage when the conductive colored particles fly from the first hole, the numeral values 2, 3, 4, and 5 have the same meaning.

When the conductive colored particles fly from the first hole, the most highest voltage−V1 is applied to the divided opposite electrode 28A and the most lowest voltage−V10 is applied to the divided opposite electrode 28B, therefore the conductive colored particles which fly slant toward the direction of the divided opposite electrode 28A. When the conductive colored particles fly from the second hole, the particles fly a little to the center part between the divided opposite electrodes in comparison with the first case, while when the conductive colored particles fly from the third hole, the particles fly toward the center part between the divided opposite electrodes because the divided opposite electrodes are equipotential. When the conductive colored particles fly from the fourth hole, the particles which fly slant toward the direction of the divided opposite electrode 28B because the electric field becomes stronger in the direction of the divided opposite electrode 28B. The conductive colored particles fly from the fifth hole, the particles which fly further slant toward the direction of the divided opposite electrode 28B to adhere to the recording medium. At this time, movement speed (speed of the periphery) of the multi-hole photoreceptor is (the pitch of the hole in the rotational direction of the multi-hole layer)×5/pixel pitch times to the moving speed of the recording medium. According to the above described constitution, the method enable the conductive colored particles which fly from five holes to adhere to the recording medium repeatedly. Voluntary number of repetition is capable of being established by the same method.

In the present embodiment, description is to carry out about the case of two divided opposite electrodes, however, the conductive colored particles which fly from a plurality of holes can adhere to the recording medium repeatedly by adjusting applying method of the voltage and so forth even though number of the hole is voluntary such as three or four and so forth. Further, in the present embodiment, since the conductive colored particles which fly from a plurality of holes form one pixel, the method has excellent gradation reproducibility in every one pixel, thus it is suitable for printing photo image.

As described above, according to the present invention, there is obtained the effect that sufficient image density is obtained, and there is no blank space, and excellent gradation reproducibility in every one pixel is obtained, thus it is suitable for printing photo image.

Because, in the present invention, one pixel is formed in such a way that the conductive colored particles which fly from a plurality of holes adhere to the recording medium repeatedly due to the fact that the multi-hole photoreceptor and/or the recording medium is driven with interrelated or a plurality of divided opposite electrodes are provided to apply voltage independently to respective divided opposite electrodes, thus it is capable of avoiding occurrence of blank space between pixels in the transfer direction. Further it is capable of avoiding occurrence of blank space between pixels in the direction perpendicular to the transfer direction, because of shifting of the arrangement of the holes of the multi-hole photoreceptor.

Furthermore, there is the effect that the present invention enables resolution of the image to be improved.

Because the conductive colored particles which fly from a plurality of holes form one pixel, therefore quantity of particles necessary for the hole of the multi-hole layer decreases, consequently, thickness of the multi-hole layer becomes thin, therefore, it becomes possible to form a smaller insulating screen, namely achieving high resolution.

While preferred embodiments of the invention have been described using specific terms, the description has been for illustrative purpose only, and it is to be understood that changes and variations may be made without departing from the spirit or scope of the following claims.

What is claimed is:

1. An image recording apparatus comprising:

a multi-hole photoreceptor of an approximate columnar shape provided with a multi-hole layer of prescribed thickness on which an electrode layer is formed only on an upper surface thereof, the multi-hole layer having a plurality of holes arranged in equal intervals, said multi-hole photo-receptor including a transparent conductive layer and a photoconductive layer that are laminated in sequential order on a transparent supporting structure;

an opposite electrode arranged so as to be oppositely-positioned with respect to said multi-hole photoreceptor with an interval therebetween while a recording medium is inserted in the interval; and an exposure unit that exposes in response to an image signal from a side of said transparent supporting structure of said multi-hole photoreceptor, wherein conductive colored particles fly from at least two of said plurality of holes of said multi-hole layer to adhere to one pixel location on said recording medium sequentially, and wherein respective pixels on said recording medium are formed due to overlapping conductive colored particles adhering to said recording medium.

2. An image recording apparatus as claimed in claim 1, wherein said multi-hole layer includes one of an insulator and a photoconductive layer.

3. An image recording apparatus as claimed in claim 2, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

4. An image recording apparatus as claimed in claim 3, further comprising:

a second exposure unit that exposes from within the multi-hole photoreceptor opposing against said opposite electrode.

5. An image recording apparatus as claimed in claim 2, further comprising:

a second exposure unit that exposes from within the multi-hole photoreceptor opposing against said opposite electrode.

6. An image recording apparatus as claimed in claim 1, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

7. An image recording apparatus as claimed in claim 6, further comprising:

a second exposure unit that exposes from within the multi-hole photoreceptor opposing against said opposite electrode.

8. An image recording apparatus as claimed in claim 1, further comprising:

a second exposure unit that exposes from within the multi-hole photoreceptor opposing against said opposite electrode.

9. An image recording apparatus comprising:

a multi-hole photoreceptor of an approximate columnar shape provided with a multi-hole layer of prescribed thickness on which an electrode layer is formed only on an upper surface thereof, the multi-hole layer having a plurality of holes arranged in equal intervals, said multi-hole photo-receptor including a transparent conductive layer and a photoconductive layer that are laminated in sequential order on a transparent supporting structure;

an opposite electrode arranged so as to be oppositely-positioned with respect to said multi-hole photoreceptor with an interval therebetween while a recording medium is inserted in the interval;

an exposure unit that exposes in response to an image signal from a side of said transparent supporting structure of said multi-hole photoreceptor; and a rotating unit that rotates the multi-hole photoreceptor in correspondence to pixels that are formed on said recording medium due to the rotation of the multi-hole photoreceptor with respect to the recording medium, wherein the conductive colored particles fly from at least two of said plurality of holes of said multi-hole layer to adhere to one pixel location on said recording medium sequentially, and wherein respective pixels on said recording medium are formed due to overlapping conductive colored particles adhering to said recording medium.

10. An image recording apparatus as claimed in claim 9, wherein said multi-hole layer includes one of an insulator and a photoconductive layer.

11. An image recording apparatus as claimed in claim 10, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

12. An image recording apparatus as claimed in claim 11, further comprising:

a second exposure unit that exposes from within the multi-hole photoreceptor opposing against said opposite electrode.

13. An image recording apparatus as claimed in claim 10, further comprising:

a second exposure unit that exposes from within the multi-hole photoreceptor opposing against said opposite electrode.

14. An image recording apparatus as claimed in claim 9, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

15. An image recording apparatus as claimed in claim 14, further comprising:

a second exposure unit that exposes from within the multi-hole photoreceptor opposing against said opposite electrode.

16. An image recording apparatus as claimed in claim 9, further comprising:

a second exposure unit that exposes from within the multi-hole photoreceptor opposing against said opposite electrode.

17. An image recording apparatus comprising:

a multi-hole photoreceptor of an approximate columnar shape provided with a multi-hole layer of prescribed thickness on which an electrode layer is formed only on an upper surface thereof, the multi-hole layer having a plurality of holes arranged in equal intervals, said multi-hole photo-receptor including a transparent conductive layer and a photoconductive layer that are laminated in sequential order on a transparent supporting structure;

an opposite electrode arranged so as to be oppositely-positioned with respect to said multi-hole photoreceptor with an interval therebetween while a recording medium is inserted in the interval;

an exposure unit that exposes in response to an image signal from a side of said transparent supporting structure of said multi-hole photoreceptor;

a rotating unit that rotates the multi-hole photoreceptor; and a moving unit that moves said recording medium and said opposite electrode at different speeds, wherein said multi-hole photoreceptor and said recording medium are mutually driven as they correspond to each other, in which conductive colored particles fly from at least two of said plurality of holes of said multi-hole layer to adhere to one pixel location on said recording medium sequentially, and wherein respective pixels on said recording medium are formed due to overlapping conductive colored particles adhering to said recording medium.

18. An image recording apparatus as claimed in claim 17, wherein said multi-hole layer includes one of an insulator and a photoconductive layer.

19. An image recording apparatus as claimed in claim 18, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

20. An image recording apparatus as claimed in claim 19, further comprising:

a second exposure unit that exposes from within the multi-hole photoreceptor opposing against said opposite electrode.

21. An image recording apparatus as claimed in claim 18, further comprising:

a second exposure unit that exposes from within the multi-hole photoreceptor opposing against said opposite electrode.

22. An image recording apparatus as claimed in claim 17, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

23. An image recording apparatus as claimed in claim 22, further comprising:

a second exposure unit that exposes from within the multi-hole photoreceptor opposing against said opposite electrode.

24. An image recording apparatus as claimed in claim 17, wherein when respective pixels on the recording medium are formed by conductive colored particles flying from Y holes in sequential order, a relationship between velocity V1 of said multi-hole photoreceptor in a rotational direction and moving velocity V2 of said recording medium is represented by a following expression (1):

$$V1=V2\times \text{a hole pitch in the rotational direction of said multi-hole layer}\times Y/\text{a pixel pitch in the rotational direction of said multi-hole layer.}$$

25. An image recording apparatus as claimed in claim 24, further comprising:

a second exposure unit that exposes from within the multi-hole photoreceptor opposing against said opposite electrode.

26. An image recording apparatus as claimed in claim 17, further comprising:

a second exposure unit that exposes from within the multi-hole photoreceptor opposing against said opposite electrode.

27. An image recording apparatus comprising:

a multi-hole photoreceptor of an approximate columnar shape provided with a multi-hole layer of prescribed thickness on which an electrode layer is formed only on an upper surface thereof, the multi-hole layer having a plurality of holes arranged in equal intervals, said multi-hole photo-receptor including a transparent conductive layer and a photoconductive layer that are laminated in sequential order on a transparent supporting structure;

an opposite electrode structure arranged so as to be oppositely-positioned with respect to said multi-hole photoreceptor with an interval therebetween while a recording medium is inserted in the interval;

an exposure unit that exposes in response to an image signal from a side of said transparent supporting structure of said multi-hole photoreceptor; and a voltage applying unit that applies voltage independently to a plurality of divided opposite electrodes that form said opposite electrode structure and that are insulated from each other, said voltage applying unit enabling control on a flying direction of conductive colored particles which fly selectively from the holes on said multi-hole photoreceptor.

28. An image recording apparatus as claimed in claim 27, wherein said multi-hole layer includes one of an insulator and a photoconductive layer.

29. An image recording apparatus as claimed in claim 28, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

30. An image recording apparatus as claimed in claim 29, further comprising:

a second exposure unit that exposes from within the multi-hole photoreceptor opposing against a central part of a plurality of divided opposite electrodes.

31. An image recording apparatus as claimed in claim 28, further comprising:

a second exposure unit that exposes from within the multi-hole photoreceptor opposing against a central part of a plurality of divided opposite electrodes.

32. An image recording apparatus as claimed in claim 27, wherein the plurality of holes on said multi-hole photoreceptor are arranged in a predetermined pitch in a longitudinal direction of the columnar shape, while a neighboring row in a rotation direction of the multi-hole photoreceptor is formed by a plurality of holes arranged in said predetermined pitch in the longitudinal direction approximately shifted by 1/X of said predetermined pitch from a preceding row, and wherein said rows of holes are repeated by a unit of X rows.

33. An image recording apparatus as claimed in claim 32, further comprising:

a second exposure unit that exposes from within the multi-hole photoreceptor opposing against a central part of a plurality of divided opposite electrodes.

34. An image recording apparatus as claimed in claim 27, further comprising:

a second exposure unit that exposes from within the multi-hole photoreceptor opposing against a central part of a plurality of divided opposite electrodes.

35. An image recording method using an image forming apparatus that includes:

a multi-hole photoreceptor of an approximate columnar shape provided with a multi-hole layer of prescribed thickness on which an electrode layer is formed only on an upper surface thereof, the multi-hole layer having a plurality of holes arranged in equal intervals, said multi-hole photo-receptor including a transparent conductive layer and a photoconductive layer that are laminated in sequential order on a transparent supporting structure;

an opposite electrode arranged so as to be oppositely-positioned with respect to said multi-hole photoreceptor with an interval therebetween while a recording medium is inserted in the interval; and an exposure unit that exposes in response to an image signal from a side of said transparent supporting structure of said multi-hole photoreceptor, the method comprising the steps of:

exposing the multi-hole photoreceptor in accordance with an image signal;

applying an electric field between the opposing electrode and the transparent conductive layer; and mutually driving said multi-hole photoreceptor and said recording medium with respect to each other, such that respective pixels on said recording medium are formed due to having conductive colored particles flying from a plurality of holes of said multi-hole photoreceptor in sequential order and that adhere to said recording medium, wherein when respective pixels on the recording medium are formed by conductive colored particles flying from Y holes in sequential order, a relationship between velocity V1 of said multi-hole photoreceptor in a rotational direction and moving velocity V2 of said recording medium is represented by a following expression (1):

$V1 = V2 \times$ a hole pitch in the rotational direction of said multi-hole layer $\times Y$/a pixel pitch in the rotational direction of said multi-hole layer.

36. An image recording method using an image recording apparatus that includes:

a multi-hole photoreceptor of an approximate columnar shape provided with a multi-hole layer of prescribed thickness on which an electrode layer is formed only on an upper surface thereof, the multi-hole layer having a plurality of holes arranged in equal intervals, said multi-hole photo-receptor including a transparent conductive layer and a photoconductive layer that are laminated in sequential order on a transparent supporting structure;

an opposite electrode structure arranged so as to be oppositely-positioned with respect to said multi-hole photoreceptor with an interval therebetween while a recording medium is inserted in the interval;

an exposure unit that exposes in response to an image signal from a side of said transparent supporting structure of said multi-hole photoreceptor, the method comprising the steps of:

exposing the multi-hole photoreceptor in accordance with an image signal while driving the multi-hole photoreceptor and the recording medium relative to each other; and independently applying a voltage to each of a plurality of divided opposite electrodes that form said opposite electrode structure and that are insulated from each other, so as to control a flying direction of conductive colored particles which fly selectively from the holes on said multi-hole photoreceptor.

* * * * *